US005732774A

United States Patent [19]

Haggard

[11] Patent Number: 5,732,774

[45] Date of Patent: Mar. 31, 1998

[54] DRILL WIPER ASSEMBLY

[76] Inventor: Archie K. Haggard, 2922 Teague, Houston, Tex. 77080

[21] Appl. No.: 573,515

[22] Filed: Dec. 15, 1995

[51] Int. Cl.[6] ..... E21B 37/02; E21B 37/04

[52] U.S. Cl. ..... 166/153; 15/104.05; 134/22.11; 166/170; 166/177.3; 166/311

[58] Field of Search ..... 166/153, 170, 166/173, 177.3, 202, 311; 15/104.05; 134/22.11; 137/15, 242; 175/84

[56] References Cited

U.S. PATENT DOCUMENTS

| | | | |
|---|---|---|---|
| Re. 32,085 | 2/1986 | Haggard | 166/170 |
| 4,221,264 | 9/1980 | Haggard | 166/177.3 |
| 4,923,011 | 5/1990 | Skipper | 166/311 |
| 5,012,866 | 5/1991 | Skipper | 166/170 |
| 5,465,791 | 11/1995 | Loitherstein | 166/202 X |

*Primary Examiner*—George A. Suchfield
*Attorney, Agent, or Firm*—Gunn & Associates, P.C.

[57] ABSTRACT

An improved pipe wiping device is set forth which incorporates from an upper end fishing neck, a threaded connection for a central mandrel and multiple pipe wiping elements which are formed of flat resilient sheet material cut in circular fashion and having notches therein. The pipe wiping elements are alternately spaced so that the notches in the pipe wiping elements are overlapped above or below by protruding pipe wiping elements. Enlarged and elongated spacers are positioned between adjacent pipe wiping elements. The central mandrel terminates at a flexible coupling formed of resilient material or a spring. It then connects with a buoyant chamber there below to cause the device to float in the drill mud in the pipe string as the pipe string is pulled from the well borehole.

13 Claims, 2 Drawing Sheets

FIG. 1
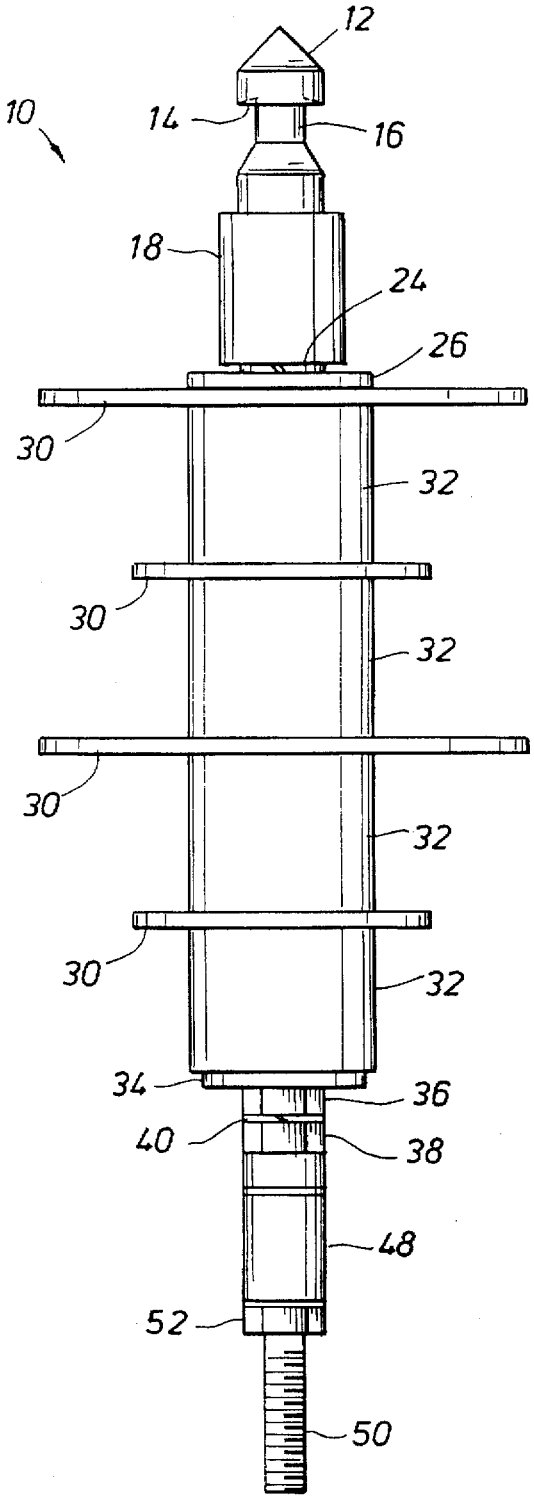
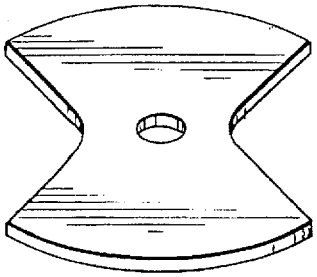
FIG. 3
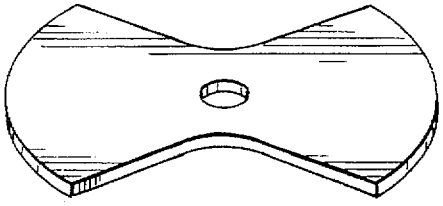
FIG. 4
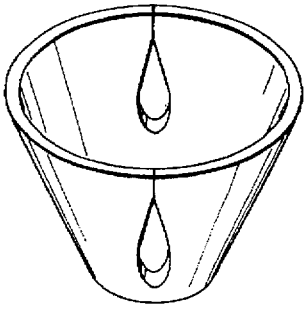
FIG. 5

DRILL WIPER ASSEMBLY

BACKGROUND OF THE DISCLOSURE

The present inventor has successfully devised and used an interior wiper for tubular goods. It is set forth first in U.S. Pat. No. 4,221,264 and also in U.S. Pat. No. 4,287,948. The two patents together show a device which is especially useful for dropping in a well during drilling procedures. It wipes the interior of the string of pipe. It can be used to clean a string of drill pipe. During drilling a well, it is necessary to circulate drilling fluid which is commonly known as drilling mud downwardly through the drill string. Ultimately, it is necessary to retrieve the drill string from the partly drilled well borehole at which time the drill string is pulled and stacked in the derrick. It is pulled typically one stand at a time, a stand being equal to three joints of pipe in ordinary circumstances. As it is pulled, drilling fluid drips from the unthreaded stand pipe and splashes on the floor. When this happens it creates a problem of slippage on the floor. This is dangerous to the rough necks who are working on the rig floor. Not only is it dangerous, it is wasteful of expensive drilling fluids. Less costly fluids are made of clay and more costly fluids are made from oil bases and additives.

Another problem relating to the spillage of drilling fluid in the rig floor derives from the pollution risk. Whether the rig is on land or at sea, when the rig flood gets dirty, there is always the chance of spillage off the rig floor either onto the surrounding land or into the body of water where the rig is located. In either instance, pollution problems can arise. Drilling mud which is spilled on a body of water may create a sheen on the surface of the water.

The device of the foregoing patents has met with very substantial success. It has been used on wells beyond count or measure. In fact, the number of wells that have been protected with this device easily number into the thousands. In other words, more than several thousands of times, a drill string has been pulled from the well borehole and the interior has been wiped. On doing this, the amount of drilling fluid splashed on the floor has been reduced.

One advantage of the present device is the effectiveness in wiping the drill pipe on the interior. There are certain disadvantages however that arise from this. For one, the device is in effect a free falling body which is dropped into the drill string. It is free falling in the sense that it is untethered and is able to fall in the pipe. Of course it does not fall in the sense of a falling rock, but rather it falls in the drill string to land on the drilling mud that is in the drill string. As an untethered and unanchored device, it is necessary to sometimes find the device and pull it from the drill string. To this end, it is made with a fishing neck at the upper end. The fishing neck features a mushroom shaped upper end which is sharpened or pointed somewhat and which has an overhanging shoulder to thereby enable a grappling device to grab the wiping device. In retrieval of the device from a well, it is often necessary to drop a fishing tool in the drill string which lands on top of the wiping device. Occasionally, the dropped fishing tool travels with sufficient speed that it bangs the interior of the pipe and damages the wiping device. Moreover, sinker bars are attached to the overshot (a grappling tool) which enables the top end of the wiping device to be grasped or held. As a further particular, the present invention is especially effective in wiping drill strings where the drill string is formed of pipe joints having internal upsets. As a generalization, joints of pipe are threaded together to define thicker threaded joints compared with the mid-points between joints. Because joints have a thicker wall, the thickness in the wall requires a surrounding shoulder which either protrudes on the interior or the exterior. It is possible to have a pipe string which is externally flush meaning that the upsets in the drill pipe form shoulders protruding inwardly. This forms an internal restriction, thereby limiting axial flow. There is also a type of pipe which has external upsets so that the interior is substantially open without restrictions or bottlenecks. It is however more common to make drill pipe with internal upsets. Thus, the device described in the previous patents has been very successful in handling internal upset pipe, wiping the bore of the pipe clean and reducing drill mud dripping on the rig floor.

The device as actually used in the field has been susceptible to tremendous damage. The damage has resulted primarily from the weight of the sinker bars attached to the grapple or overshot. Such devices can bend or destroy the upper end of the wiping device. They may strike the fishing neck and grasp it, but the structure there below is often bent or twisted. It is compressed, jamming downwardly, and thereby forming a distorted bend in the pipe and preventing movement upwardly in response to the retrieval equipment including the grapple or overshot. The present disclosure sets forth an improved upper end construction which is able to handle that type of necessary abuse in the field. Moreover, it provides an enhancing wiping apparatus. The wiping is enhanced so that the drilling fluid which accumulates on the wall of the drill pipe is wiped downwardly. This wiping mechanism is enhanced in operation and is therefore quite successful in handling all types of pipe and especially pipe having internal upsets.

The present disclosure therefore sets forth an upper end for the wiper mechanism which is able to withstand the rigors of field use. Moreover, the present disclosure is directed to a wiper construction which is easily repaired should it be inadvertently damaged. It has the fishing neck at the upper end to enable the grapple supported on a wire line to retrieve the device. It can especially withstand the impact of the grapple even when the grapple is weighted in free fall by several hundred pounds of sinker bars attached to the grapple.

SUMMARY OF THE INVENTION

Summarizing, the apparatus of the present disclosure represents an improvement over that structure which is set forth in the foregoing patents and which further includes a set of resilient wiper discs or protruding resilient wipers. The wiper elements are formed of relatively thin stock and have the preferred form of sheet material cut in a circle and notched at one or two locations in the circle to enable folding as the wiper elements are bent when passing through internal upsets in the pipe string. The upper end construction comprises a set of relatively large diameter spacers which define the requisite spacing of the wipers. The length of the spacers controls the amount of protruding wiper to assure that all the wipers do not fold over and overlap. Moreover, the spacers provide structural reinforcing so that the upper end is formed in a more rugged manner and thereby resists bending when exposed to banging and vigorous usage.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 side view of the improved pipe wiping apparatus of the present disclosure particularly showing construction of the upper end to resist damage which occurs in use and operation;

FIG. 3 is a perspective view of a wiper;

FIG. 4 is a perspective view of a wiper rotated by 90° ; and

FIG. 5 is a perspective view of a wiping element which has been folded as occurs during traversing of internal upset pipe.

DESCRIPTION OF THE PREFERRED EMBODIMENT

Figure 2:
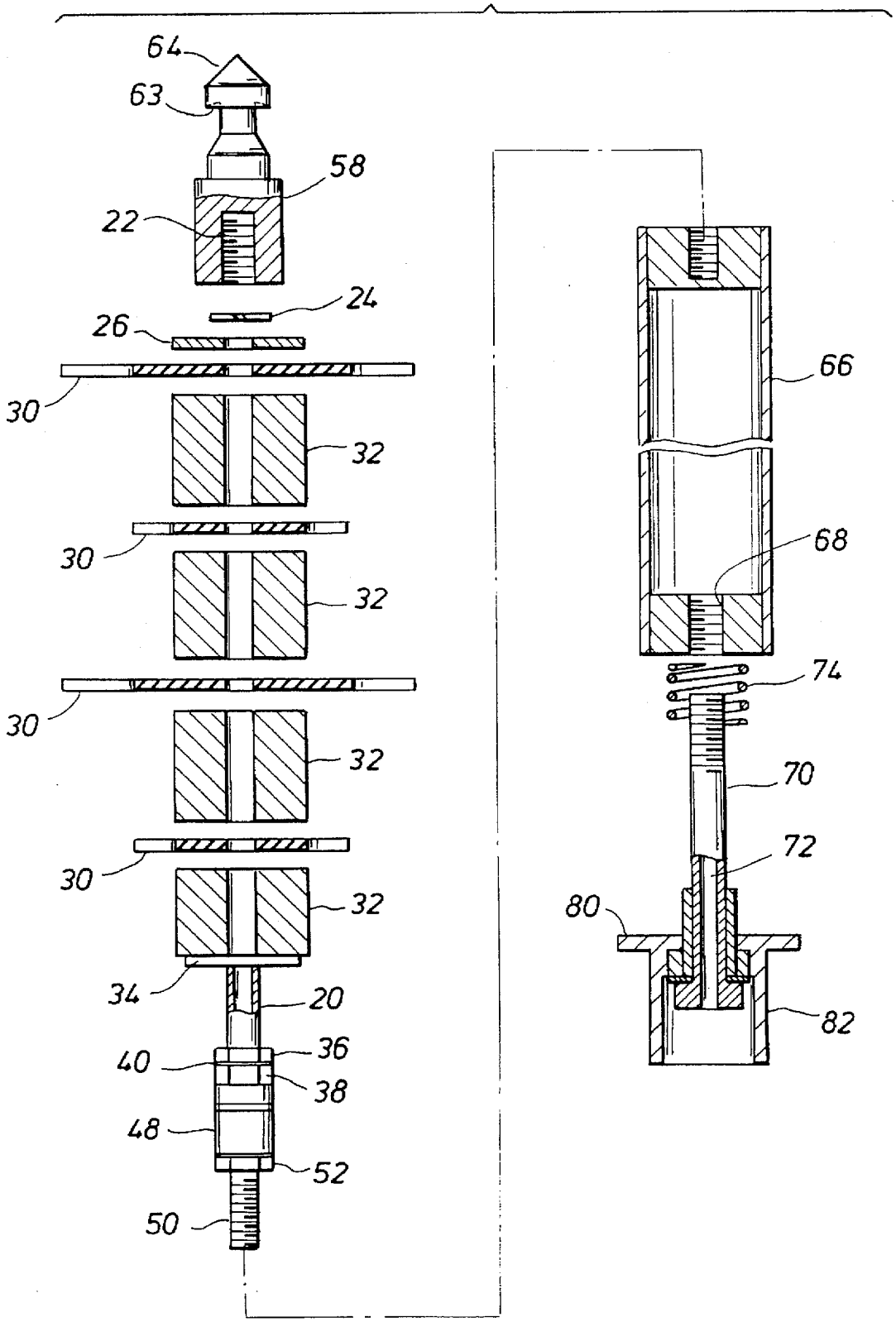
FIG. 2 is an exploded view of the wiping apparatus of FIG. 1 showing the relative connection of the components so that the device can be readily assembled and further showing the entire system on a common centerline axis for assembly.

Attention is directed to FIG. 1 of the drawings which shows the reinforced stronger upper end portion of the wiping device 10 of the present disclosure. The device 10 is the device shown in the two cited references mentioned above. It includes a type of bladder mechanism as described in those references. FIG. 1 is the structure at the upper end which is made in a different fashion to resist the banging and stress resultant from actual use so that the device lasts much longer and is able to survive the rough environment in which it is used. The upper end of the wiper apparatus identified at 10 is also shown in FIG. 2 of the drawings which is an exploded view showing the components and how they are put together or assembled.

Considering therefore FIGS. 1 and 2 jointly and proceeding from the upper end of the tool, it will be noted that the device has a fishing neck 12 constructed with an overhanging shoulder 14 adjacent to a narrow or constricted neck 16 which enables grasping with a fishing tool or some other type of grappling device. The fishing neck is constructed in accordance with an industry standard to fit within an overshot or grapple tool. It connects to an enlarged neck portion 18 which is axially hollow and drilled from the bottom. The neck 18 is internally threaded so that it will thread to a long hollow pipe 20 specifically delineated in the exploded view of FIG. 2. The pipe 20 is sufficiently long that it supports the various components in the assembled state and threads to the interior of the neck 18. This has the form of internal threads 22 which are formed for connection with the pipe 20. The pipe 20 supports all the equipment and holds it together. Going further down the structure, a lock washer 24 is also illustrated and it is included to abut a lower end of the neck 18, and is locked on top of a flat washer 26. The flat washer is used to clamp the top wiper 30. There are several wipers 30 which are spaced along the structure and they all have the same reference numeral. They look different in the drawings because they are viewed from a different perspective. This will be understood on review of FIGS. 3 and 4 jointly. The washer 26 clamps over the wiper element 30. The wiper element is formed of resilient material and has a protruding peripheral outer edge which is folded or bent during transition through the upsets on the interior of the pipe string. The wiper 30 is formed with a small central hole which is sized to fit around the pipe 20. This enables proper axial alignment of all the components when assembled as shown in FIGS. 1 and 2.

A spacer 32 is included below the wiper 30. The spacer 32 has an outer diameter that is approximately equal to that of the washer 26. This enables the wiper element to be clamped on the top and bottom faces with equal area components clamping against this resilient member. This enables the wiper 30 to flex, but it is secured so that flexure does not tear the wiper away from the supporting washer 26 or spacer 32. As will be further observed in FIGS. 1 and 2 of the drawings, the spacers are repeated at several locations, there being four spacers 32 in the illustrated and preferred embodiment. In like fashion there are four wipers 30 which are shown also in the preferred embodiment. While it is not obligatory to use four spacers and four wipers, it has been found that better wiping is accomplished with four wipers. Of particular note is the fact that the first and third wipers, counting from the top, have maximum diameters at one dimension, and the second and fourth wipers have an equal larger diameter at another dimension. The four wipers alternate in relative position with respect to the mounting pipe 20 which supports the several wipers. More particularly, the wipers are deployed so that they protrude outwardly and are able to engage the wall of the drill pipe in a fashion that will be detailed later.

The four wipers are all clamped as noted and clamping action is furnished in part by the spacers 32. The bottom spacer 32 is supported on a thrust washer 34. The washer 34 fits on the exterior of the pipe 20. The washer 34 is constructed so that it holds up the entire stack of wipers and spacers. The washer 34 seats against or bottoms against a pair of lock nuts 36 and 38, there being a split ring washer 40 between the two. The split ring washer 40 assures that the nuts 36 and 38 are under tension so that accidental unthreading is prevented. The two lock nuts 36 and 38 are threaded on the exterior of the pipe 20. They are used to connect with or anchor a resilient connective sleeve 48. The sleeve 48 is a flexible joint. An alternate form is a coil spring of the sort that is shown at the lower end of the equipment. Indeed, such a flexible joint is shown in the referenced patents of the present apparatus. A resilient sleeve of rubber like material is preferably used. It has an external form of a cylinder and it is bonded to the pipe 20. The pipe 20 preferably does not pass fully through the plug 48. Rather, the pipe is discontinuous so that there is the upper pipe section 20 previously defined and a similar but disconnected lower pipe section 50 there below. The two pieces 50 and 20 can connect at end located chain links or the like. This defines the flex joint previously mentioned so that bending can occur in this region without bending permanently the pipe 20 which would occur in the event it were continuous. The rubber sleeve 48 enables bending.

The flexible joint 48 is locked in position by a separate nut 52 at the bottom side thereof. The rubber sleeve 48 enables flexure of the tool which, when assembled, is several feet in length. A large amount of flexure is not normally encountered; rather, the flexure is only a few degrees but this is sufficient to prevent breaking the equipment when dropped in a drill string.

FIG. 2 shows the remainder of the equipment which is connected in the system. In accordance with the teachings of the two mentioned patents above, there is a buoyant chamber 66 which threads with the pipe 50. The pipe 50 is preferably a solid pipe connected to the chamber 66. Structural strength and integrity are enhanced by the use of a solid rod or pipe. In like fashion, the pipe 20 thereabove is shown to be hollow but it also can be solid. There is no need to sustain a fluid flow pathway along the pipe 20. Whether solid or hollow, strength is achieved by selecting a pipe of sufficient stiffness so that bending does not occur. The buoyant chamber 66 operates in the manner set forth in the two referenced patents, and one version of the lower part of the structure there below is set forth in detail in those disclosures. In FIG. 2, the pipe 50 threads to the top of the chamber 66, and the hollow pipe 70 threads to the bottom. This creates an open passage into the chamber 66 through the pipe 70 which is plugged by a moldable resilient plug 72. The plug 72 is blown out of the hollow pipe 70 to serve as an over pressure relief system to avoid crushing the chamber 66. A spring 74 is coiled around the pipe 70 and bears on a replaceable disc 80. The disc 80 is sized to limit travel into tool joints where tool snagging might occur. The disc 80 can be replaced. The lower most sleeve 82 is the bottom termination and it can be the same as or different from the disc 80 in size. The disc 80 and the sleeve 82 are limit devices to prevent entry into restricted passages.

In operation, the device of the present disclosure is assembled above the buoyant chamber 66 to enable a proper level of buoyancy to be obtained. Since the spacers 32 add weight, the buoyant chamber 66 can be made larger. This will counter balance the added weight. The wiping tool 10 is dropped in the drill string and the wipers 30 reach out to wipe the surface of the pipe on the interior, pushing mud downwardly as the device falls relatively down into the pipe string. The wipers 30 are kept above the level of the mud which establishes a hydrostatic head in the drill string. The wipers 30 are readily passed through the internal upsets in the pipe. This is made more clear on viewing FIGS. 3 and 4 jointly. There, the wipers are identical in construction but they are positioned 90° out of phase; this positioning enables the wipers to reach out and wipe the interior surface of the pipe so that any mud on the inside wall is forced downwardly. Moreover, the 90° rotation between adjacent wiping elements assures that there are no notches which align so that the full 360° of the interior pipe is wiped. During free fall or when floating on the column of mud in the pipe string, the wipers continue to push the mud downwardly even when the wipers pass through an upset. A portion of the wipers is bent upwardly; that bending occurs as the wipers pass through the joints in the drill pipe. Of particular importance to the present disclosure, FIG. 5 shows how they are folded upwardly. When folded in this fashion, they continue to wipe with the nether face so that mud is forced downwardly in the drill pipe. Further, the wiping action achieved by this mechanism assures continued successful operation on passing through many internal upsets. On transition through the joints, the wipers fold upwardly. It is especially important to note that the spacers 32 are sufficiently tall and the wipers are spaced sufficiently apart that one wiper does not overlap on the adjacent wiper. This might otherwise bind when passing through the internal upsets. Such binding action might otherwise occur but does not occur in this instance because the flexure of the wiping elements 30 is limited.

In operation, the device of the present disclosure is dropped into a drill string when pulling the drill string from a well borehole in which drill fluid has accumulated on the inside of the pipe. Because of buoyancy, the device floats in the column of drilling mud in the pipe. As the pipe is pulled upwardly, the device travels relatively downwardly in the drill string. When passing through the pipe, the wipers 30 force drilling fluid on the sidewall downwardly and keep the pipe relatively clean. In this motion, wiping is accomplished both in the drill pipe where it is full gage and also at the upsets where it is reduced in diameter. When passing through the upsets, the resilient wipers are bent or folded in the fashion shown in FIG. 5 of the drawings.

If the device is retrieved with a grapple or overshot, the grapple is dropped into the drill string, typically supported below 200 to 300 pounds of sinker bars, and lands on the fishing neck. When that occurs, there is the risk of bending the inside wiping device but that is markedly reduced by the incorporation of the spacers 32 deployed at the upper of the equipment. The spacers 32 particularly have a diameter sized with respect to the internal upsets through which the device 10 will pass so that there is adequate room but they are sufficient large in diameter that pounding on the upper end of the equipment does not ordinarily bend the equipment. Rather, the diameter of the spacers is correlated to the most narrow passage in the pipe string to permit use of this equipment.

While the foregoing is directed to the preferred embodiment, a scope is determined by the claims which follow.

What is claimed is:

1. A pipe wiping apparatus for use within a string of wet pipe wherein the pipe wiping apparatus comprises:

(a) first, second and third laterally extending resilient wiping elements;

(b) a structural reinforcing elongate spacer between said first and second wiping elements; and a second structural reinforcing elongate spacer between the second and third wiping elements; and (c) a central mandrel securing said wiping elements and spacers in serial relationship to define the upper end of the apparatus; and (d) wherein said spacers (i) are elongated, cylindrical members fitting coaxially around said mandrel, (ii) have an enlarged diameter which enables said spacers to pass through internal upsets in the pipe and permitting clearance on the exterior thereof for said pipe wiping elements so that flexure of said pipe wiping elements enables said spacers and pipe wiping elements folded there against to pass through internal upsets in the pipe string, and (iii) said enlarged diameter encircles said mandrel to enhance strength thereof.

2. The apparatus of claim 1 including a threaded nut locking relative to said mandrel so that said spacers are locked serially about said mandrel.

3. The apparatus of claim 1 including a top end mounted fishing neck on said mandrel having a connection to said mandrel.

4. The apparatus of claim 3 wherein said mandrel has a lower end connected to a solid resilient member to enable bending and threading into a buoyant chamber.

5. The apparatus of claim 4 wherein said spacers are sufficiently tall so that said wipers may bend against said spacers and do not extend to adjacent wipers and overlap thereover.

6. A wiping apparatus for wiping drilling fluid on the interior wall of a pipe string as the pipe string is pulled from a well borehole wherein the pipe wiper comprises:

(a) a central supportive mandrel having upper and lower ends;

(b) first and second spaced wipers extending transversely from said mandrel wherein said first and second wipers are flexible sheet material of finite thickness and said wipers fold over during wiping and said wipers are individually mounted without folding over wiping elements overlapped thereby;

(c) an elongate cylindrical spacer between said wipers to separate said wipers by a specified distance wherein said spacer has an enlarged diameter so that only one wiper can fold there against while passing through said nine string and so that two wipers cannot fold there against;

(d) locking means for supporting fixing said spacer and wipers on said mandrel;

(e) a flexible section serially connected to the lower end of said mandrel which flexes thereby absorbing shock;

(f) a buoyant chamber below said flexible section so that said buoyant chamber is exposed to reduced shock upon impact of a grapple or overshot dropped into the pipe string and landing on said mandrel.; and (g) an assembly below said buoyant chamber which comprises a bottom located contact member.

7. The apparatus of claim 6 including a fishing neck having a spear point at the upper end with an overhanging shoulder and also including a threaded connection to said mandrel.

8. The apparatus of claim 7 wherein said flexible section comprises an elongate resilient member having an upper end connected to said mandrel, and a lower end connected to said buoyant chamber.

9. The apparatus of claim 8 further including an elongate threaded member connected between said resilient member and said buoyant chamber.

10. The apparatus of claim 9 wherein said spacers are solid cylindrical members having parallel upper and lower end faces, and said solid cylindrical members are provided with an axial passage fitting around said mandrel.

11. The apparatus of claim 10 wherein said wipers are notched to enable folding or bending against said spacers.

12. The apparatus of claim 1 wherein said wiping elements have a width exceeding the internal diameter of the string of wet pipe, and flex to fold for passing through internal pipe upsets, and said wiping elements are (a) shaped with at least two petals;

(b) said petals are cut at edges from the outer periphery thereof;

(c ) said petals flex limited by petal edge abutment; and (d) said petals are resiliently biased to restore said wiping elements to a planar shape.

13. The apparatus of claim 6 wherein said wiping elements have a width exceeding the internal diameter of the string of wet pipe, and flex to fold for passing through internal pipe upsets, and said wiping elements are circular having notches cut therein to enable folding into an edge abutting contact by said notches on folding.

* * * * *